US005147223A

United States Patent [19]

Black et al.

[11] Patent Number: 5,147,223

[45] Date of Patent: Sep. 15, 1992

[54] ELECTRICAL CONNECTOR CONTAINING COMPONENTS AND METHOD OF MAKING SAME

[75] Inventors: Teresa K. Black, Etters; James M. English, Harrisburg; Homer E. Henschen, Carlisle; Joseph M. Pawlikowski, Lancaster, all of Pa.

[73] Assignee: AMP Incorporated, Harrisburg, Pa.

[21] Appl. No.: 863,523

[22] Filed: Apr. 3, 1992

Related U.S. Application Data

[63] Continuation of Ser. No. 673,623, Mar. 22, 1991, abandoned, which is a continuation-in-part of Ser. No. 586,362, Sep. 21, 1990, Pat. No. 5,018,989.

[51] Int. Cl.[5] ..... H01R 13/66

[52] U.S. Cl. ..... 439/620; 333/185; 29/832

[58] Field of Search ..... 439/620, 608; 333/181-185; 29/827, 832, 842, 848, 854, 883

[56] References Cited

U.S. PATENT DOCUMENTS

| | | | |
|---|---|---|---|
| 4,256,945 | 3/1981 | Carter et al. | 219/10.75 |
| 4,626,767 | 12/1986 | Clappier et al. | 323/280 |
| 4,659,912 | 4/1987 | Derbyshire | 219/535 |
| 4,682,129 | 7/1987 | Bakermans et al. | 333/184 |
| 4,709,253 | 11/1987 | Walters | 357/68 |
| 4,729,743 | 3/1988 | Farrar et al. | 439/276 |
| 4,772,225 | 9/1988 | Ulery | 439/620 |
| 4,789,767 | 12/1988 | Doljack | 219/10.57 |
| 4,804,332 | 2/1989 | Pirc | 439/620 |
| 4,852,252 | 8/1989 | Ayer | 29/860 |
| 4,929,196 | 5/1990 | Ponn et al. | 439/620 |
| 4,990,736 | 2/1991 | Henschen et al. | 219/10.75 |
| 5,010,233 | 4/1991 | Henschen et al. | 219/209 |
| 5,032,703 | 7/1991 | Henschen et al. | 219/85.22 |
| 5,090,116 | 2/1992 | Henschen et al. | 29/827 |

OTHER PUBLICATIONS

U.S. application Ser. No. 07/277,116 Henschen et al.

U.S. application Ser. No. 07/277,362 Henschen et al.

*Primary Examiner*—Larry I. Schwartz

*Assistant Examiner*—Kevin J. Carroll

*Attorney, Agent, or Firm*—Anton P. Ness

[57] ABSTRACT

An electrical connector adapted to protect its signal circuits against power surges for at least ESD protection, having a conductive shell (60) with a transverse flange (64) on which are mounted components such as diodes (100) having first electrodes soldered thereto for grounding. A plurality of discrete straps (114) extend from second electrodes of the diodes to respective the contacts (20) and define circuits electrically connecting the contacts to the diodes. The dielectric housing (30) includes slots (46) along side surfaces within which the straps are retained, and a lateral housing flange (42) has recesses (54) within which the diodes are disposed. The method of fabricating the connector includes providing on at least a portion of each strap (114) a thin second layer (152) of magnetic material which in conjunction with the nonmagnetic copper layer (150) defines a self-regulating temperature heater when subjected to RF current, to reflow solder to join to and electrically connect the diodes (100) and contacts (20).

7 Claims, 5 Drawing Sheets

Fig. 7
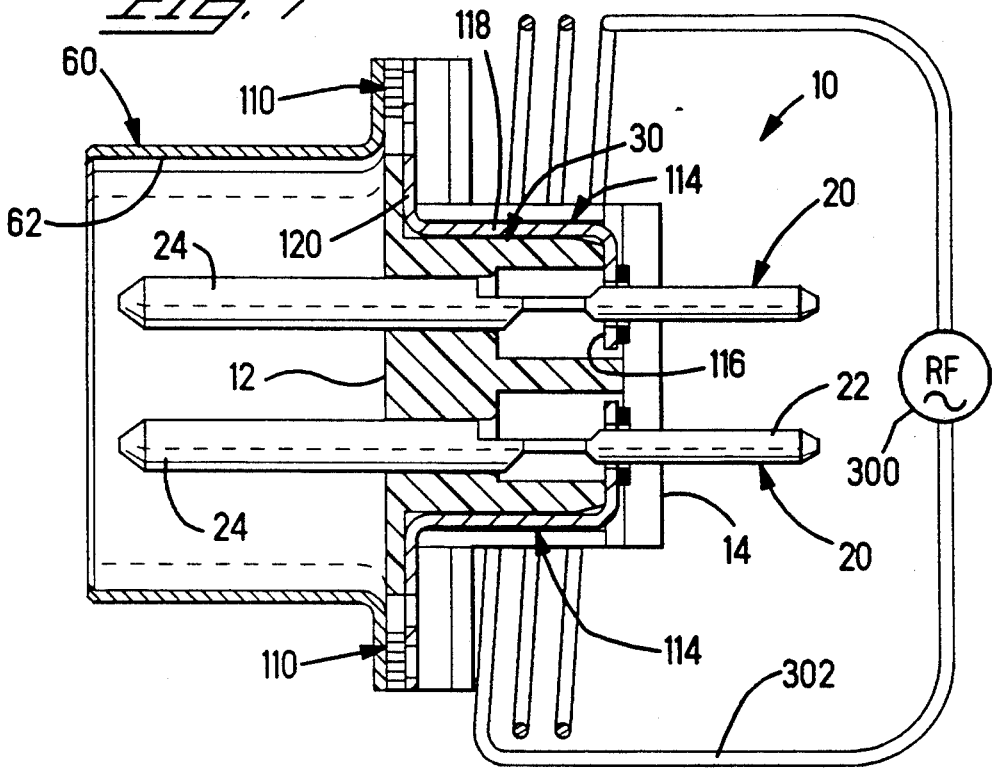
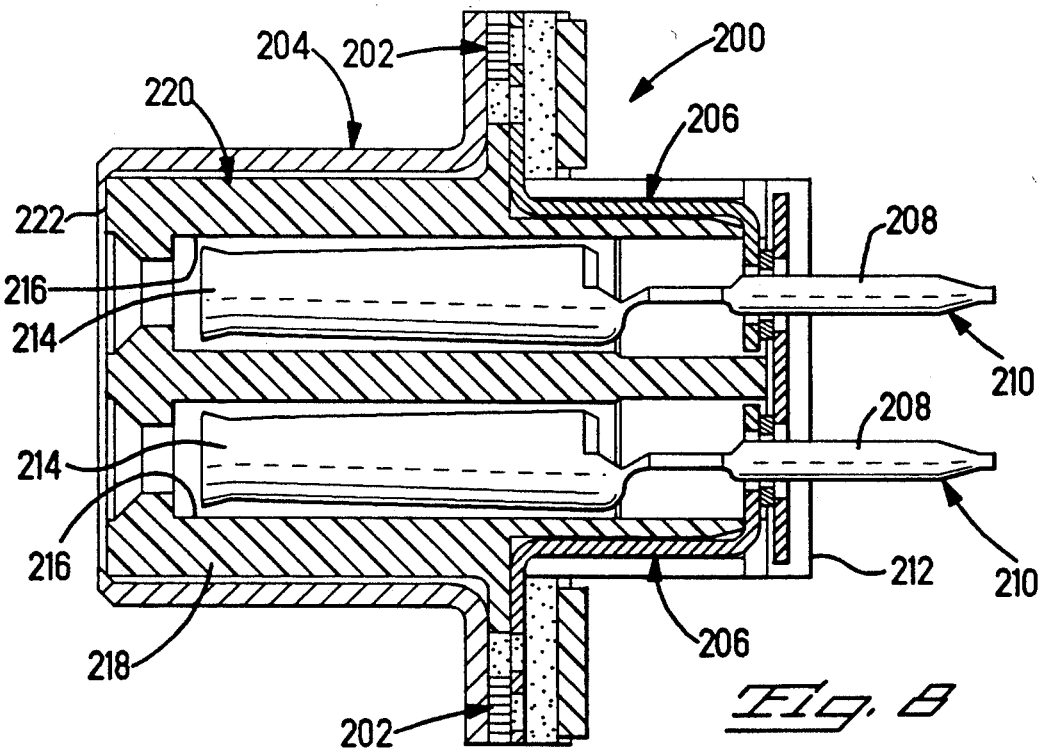
Fig. 8

ELECTRICAL CONNECTOR CONTAINING COMPONENTS AND METHOD OF MAKING SAME

REFERENCE TO RELATED APPLICATION

This application is a continuation of application Ser. No. 07/673,623 filed Mar. 22, 1991, now abandoned, in turn, a Continuation-in-Part Application of U.S. patent application Ser. No. 07/586,362 filed Sept. 1, 1990, now U.S. Pat. No. 5,018,989.

FIELD OF THE INVENTION

The present invention relates to the field of electrical connectors and more particularly to connectors containing electrical components in addition to contacts, such as components for protection of signal lines against noise or against power surges.

BACKGROUND OF THE INVENTION

Electrical connectors are known having a plurality of electrical contacts therein for mating with corresponding contacts of a mating connector for signal transmission, in which each signal line is electrically connected to a discrete component on or in the connector. In U.S. Pat. No. 4,804,332 each contact is connected to one electrode of a discrete filter member while the other electrode is connected by a ground member to the connector shell and then to chassis ground; the signal lines are thus protected against electronic noise such as electromagnetic interference (EMI) and radiofrequency interference (RFI). For example, appropriately selected filter members can assuredly filter out noise in the lower frequency ranges such as under 500 megahertz from the signal lines of the connector. The filter members are mounted in a common housing component which is then securable to an electrical connector such as a conventional connector so that first electrodes of filter members become electrically connected by means of discrete straps to the contacts mounted in the connector, or to discrete circuits connected to the contacts; second electrodes of the filter members are electrically connected to a separate ground bus member which then includes a portion extending outwardly from the component to be connected (such as by soldering) to the shell, for example, of the connector for grounding. Contact sections of the bus member and of each discrete strap can be exposed within apertures of the component housing into which the filter members can be inserted for soldering to the pairs of contact sections. In U.S. Pat. No. 4,804,332 the discrete circuit straps may be of the type having an apertured plate portion formed and situated to extend to the position of a pin section of the corresponding connector contact, with all plate portions in a common transverse plane to be inserted simultaneously over the pin sections of all the contacts during assembly of the filter-containing component to the connector, whereafter the plate portions are soldered to the respective pin sections. The reference thus discloses a filter-containing component which can be retrofitted onto preexisting connectors such as by being mountable externally of the connector.

It is also desirable to protect the signal lines of a connector from disruptions caused by power surges owing to electrostatic discharges (ESD) and electromagnetic pulse (EMP). Diode components are known such as from U.S. Pat. No. 4,709,253 for ESD and EMP protection, which can be mounted to individual contacts such as in U.S. Pat. No. 4,772,225, or to transverse dielectric plate members assembled within the connector such as in U.S. Pat. No. 4,729,743 having discrete circuits extending to each contact passing through the plate and ground circuits extending to the surrounding metal shell.

It is desirable to provide a connector containing components such as zener diodes for ESD or ESD/EMP protection which are easily assembled with few required parts and also which do not require more than negligible increase in the size of an otherwise standard sized connector.

It is also desirable to provide discrete diodes for closely spaced contacts of a multiterminal connector without modification of the positions of the contacts within the connector which would change the mating interface of an otherwise standard connector interface, nor require modification of the contacts.

SUMMARY OF THE INVENTION

The present invention is a method of fabricating a connector having one or more rows of signal contacts disposed in a housing which is secured within a metal shell or the like, with each contact electrically connected to a respective diode such as a zener diode for ESD or ESD/EMP protection. The diodes are mounted on and soldered at a first electrode to a conductive means such as to a flange of the connector shell at selected locations such as by using a template. Discrete straps are defined on a lead frame and can be assembled to the connector to extend from each contact location to a corresponding diode location to be soldered to both the strap and to a second electrode of the diode. A coating of potting material is preferably placed over the diodes and the connections to the straps and the shell for sealing the diodes and the solder joints thereof. Preferably protective covers are then secured to the connector protecting the straps and the diodes and their connections.

The discrete straps may be of the type having at a first end a first strap section having an aperture therethrough to be placed over a pin section of the corresponding contact of the connector during assembly. Each strap has a second end initially joined to a carrier strip of the lead frame which defines a second strap section to be placed adjacent an electrode of a respective diode mounted on the shell flange. An intermediate strap section joins the first and second strap sections and is wider than at least the second strap section; each strap can be formed so that the intermediate strap section extends axially or parallel to the connector contacts, while both the first and second strap sections extend transversely from the intermediate strap section. As the lead frame is mounted onto the connector with pin or post sections of the connector's contacts extending through respective apertures of the first strap sections, the intermediate strap sections enter axial slots defined along the outwardly facing surface of the connector housing with the second strap sections extending transversely away from the housing outer surface and out of the slots.

A peripheral flange extends transversely outwardly from the housing adjacent to and just forwardly of the shell flange upon assembly, and includes discrete recesses communicating with the slots at each diode location to receive the second strap sections thereinto for precise locating thereof and to maintain the alignment of the second strap sections during assembly. Further the peripheral flange includes apertures at ends of the recesses within which are disposed the respective diodes extending forwardly from the surface of the shell flange. The second strap sections physically engage the second electrodes of the respective diodes and then are soldered thereto, and the second strap sections may contain at least one small hole therethrough aligned with the diode for solder paste to be disposed for reflow, and may contain a second small hole to permit cleaning of flux from the connector after soldering. The carrier strips may be broken from the second ends of the straps before or after soldering, as desired.

In accordance with the method of the present invention, the straps include a thin layer of high magnetic permeability, high resistance metal such as along the intermediate strap section and near the first and second strap sections and thereby comprise a self-regulating temperature heater for reflowing the solder when subjected to radio frequency current, as is taught in U.S. Pat. No. 4,852,252.

It is an objective of the present invention to provide a connector which includes integral protection of its signal circuits against ESD and EMP.

It is another objective to provide such a connector which is not increased in size in its transverse dimensions.

It is a further objective to provide such a connector which is adapted for easy and accurate assembly with inspectability of solder joints.

It is yet an additional objective to provide a method for fabricating such a connector wherein the components can easily be electrically connected to circuit straps, and preferably the circuit straps be electrically connected to the respective contacts, by providing for the circuit straps themselves to comprise the means to reflow solder for establishing the connections by heating to a controlled temperature upon induction of RF current, sufficient to reflow the solder.

An embodiment of the present invention will now be disclosed by way of example with reference to the accompanying drawings.

BRIEF DESCRIPTION OF THE DRAWINGS

FIG. 7 is a cross-sectional view of the connector of FIG. 4 partially assembled being subjected to RF current to reflow solder to join the straps to the diodes and contacts; and FIG. 8 is a longitudinal section view of a plug type connector having socket contacts therein and containing the present invention.

DETAILED DESCRIPTION OF THE PRESENT INVENTION

Figure 1:
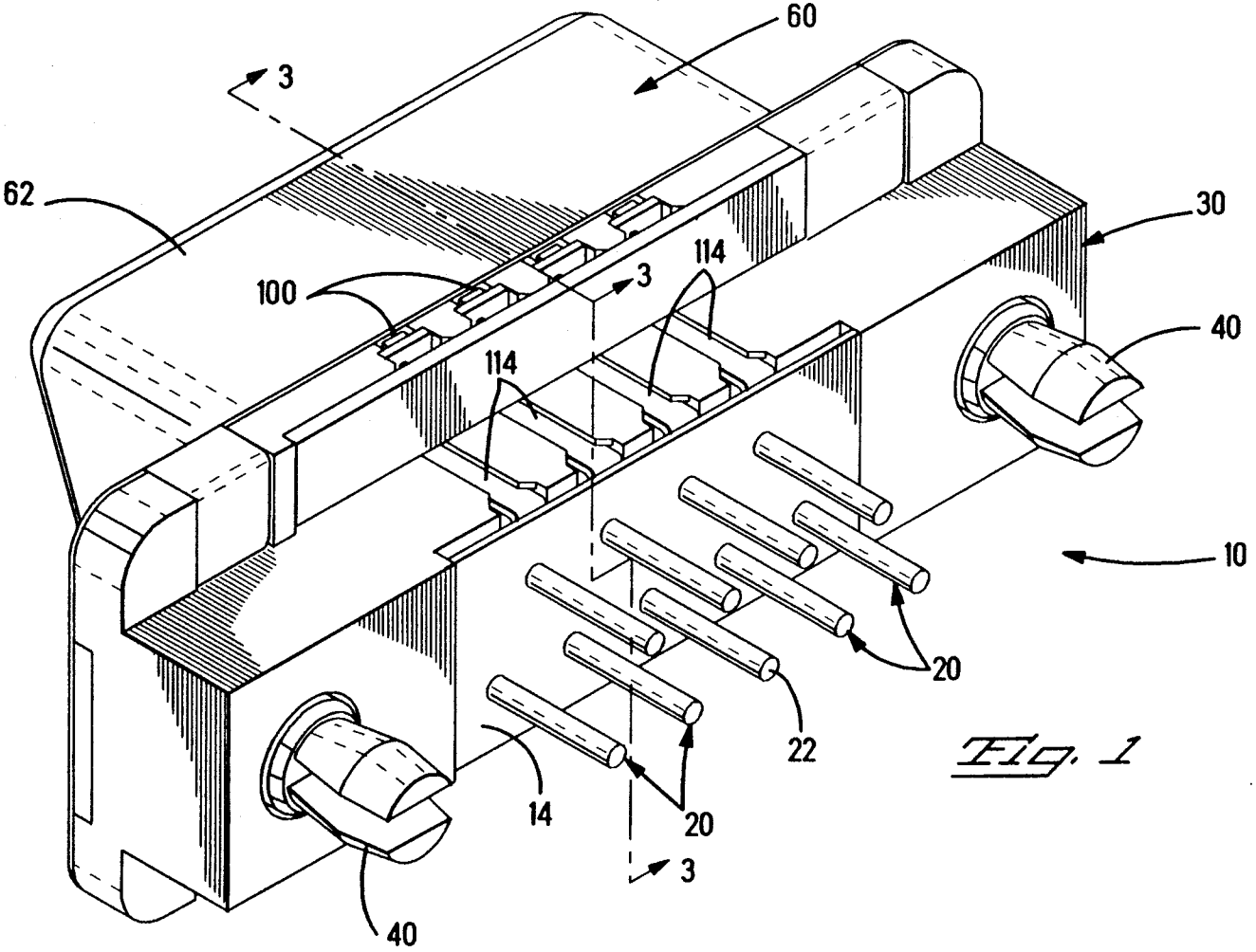
FIG. 1 is an isometric view of a completely assembled receptacle type connector with pin contacts and containing the present invention.

Connector assembly 10 is illustrated in FIG. 1 which is a receptacle type connector containing two rows of contacts 20 mounted in respective passageways 32 (FIG. 2) of a dielectric housing 30, and having a metal shell 60 secured on the mating end 12. Contacts 20 include first pin sections 22 coextending outwardly from mounting face 14 of connector 10 to be inserted into plated through-holes of a printed circuit board (not shown) and soldered, and may also optionally comprise solder tails adapted for surface mounting onto surface traces of a printed circuit board, if desired. Metal shell 60 defines a hood 62 surrounding second pin sections 24 (FIG. 3) for protection thereof in a configuration adapted to mate with corresponding socket contact sections of contacts of a mating plug connector (not shown) having a plug portion adapted to be received into hood 62.

Figure 2:
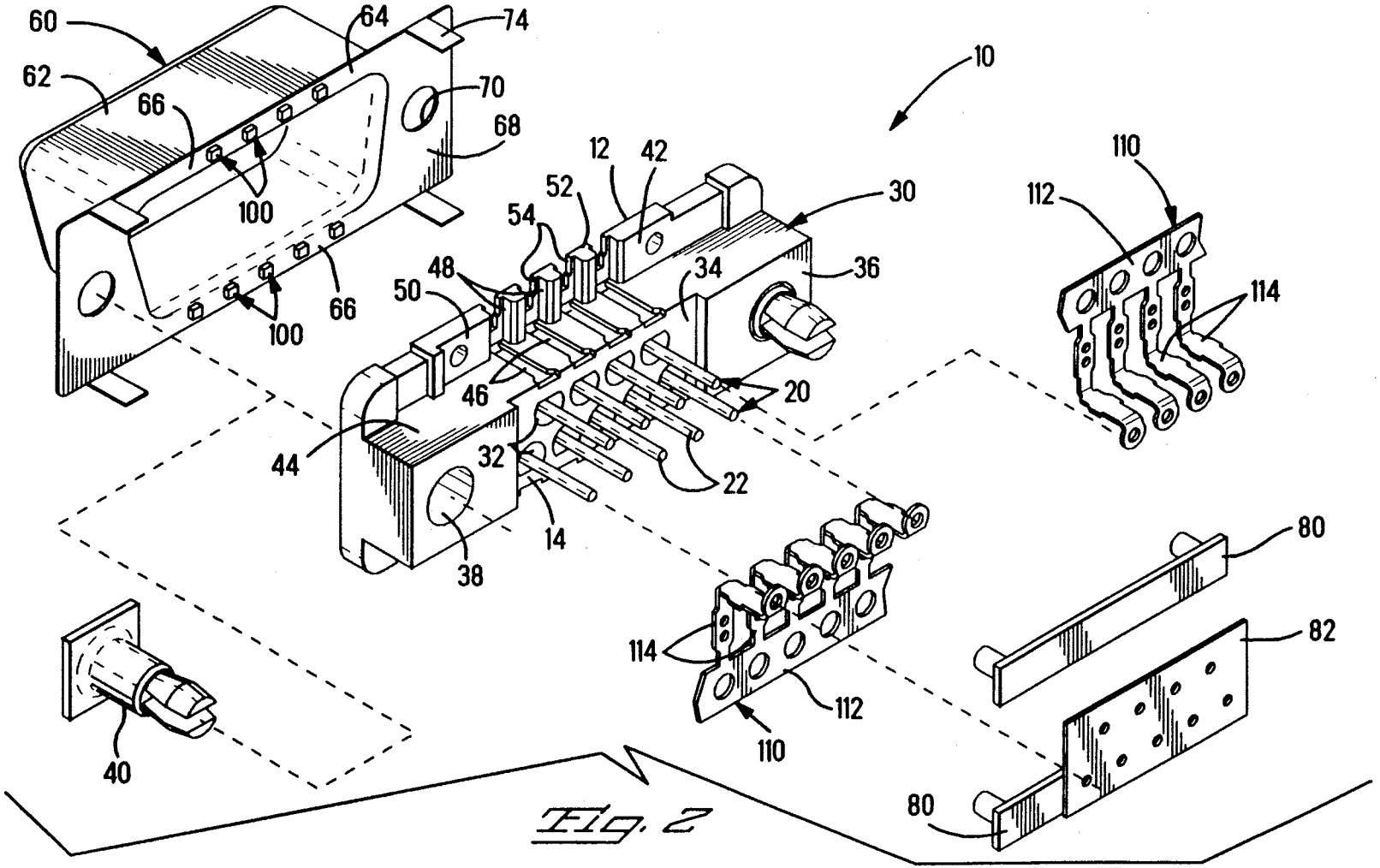
FIG. 2 is an isometric exploded view of the connector of FIG. 1, showing the diodes mounted on the shell flange and the discrete straps still secured in integral lead frames.
Figure 3:
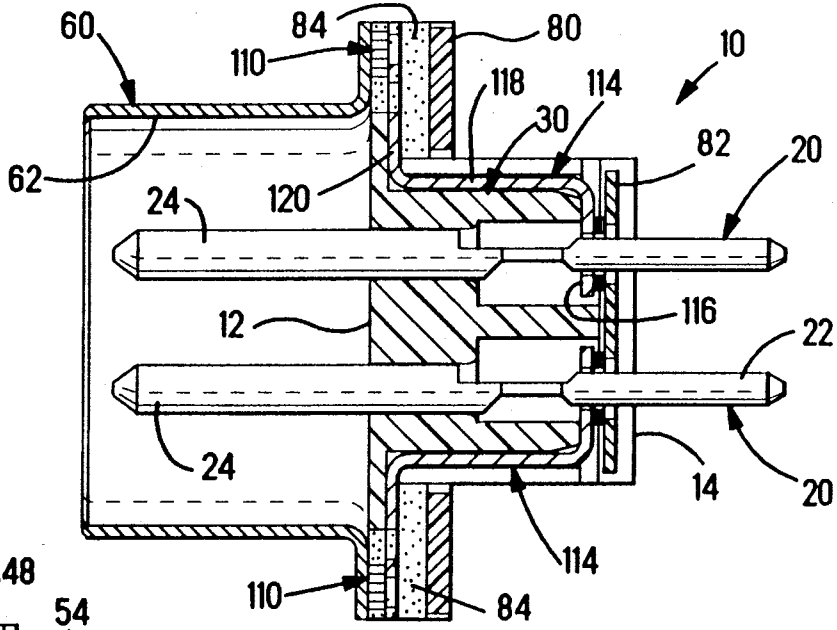
FIG. 3 is a longitudinal section view of FIG. 1 taken along lines 3—3 thereof.
Figure 4:
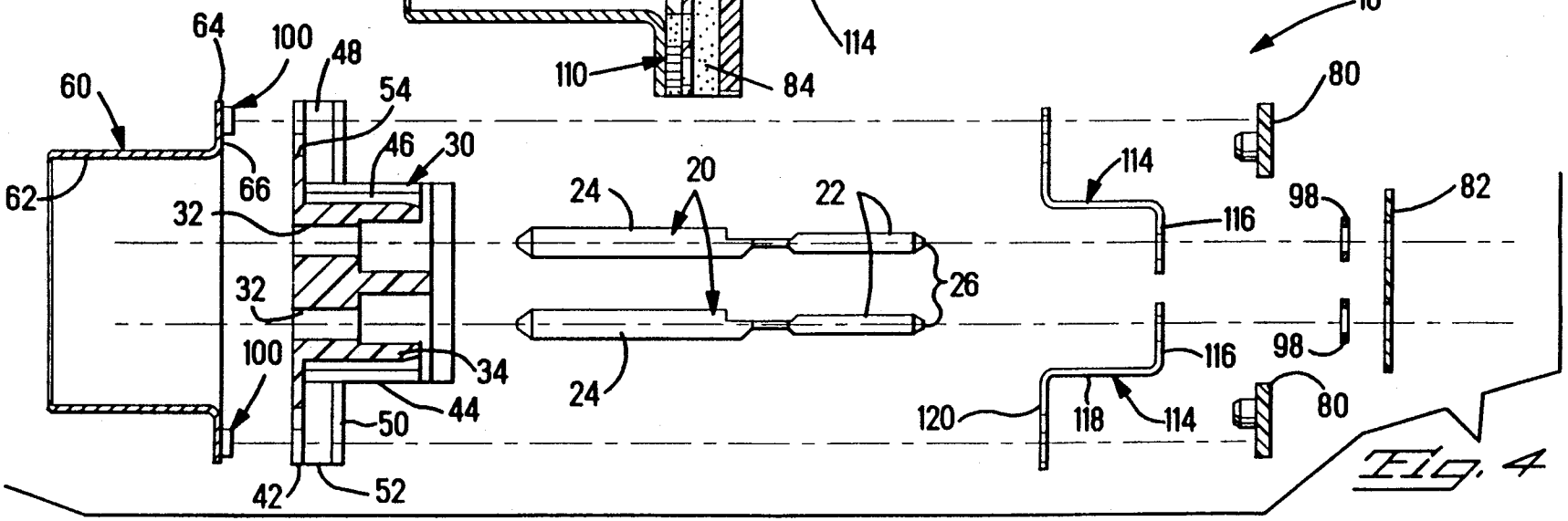
FIG. 4 is an exploded section view similar to FIG. 3.

In FIGS. 2 through 4 are seen the parts of connector assembly 10, with the assembled connector in cross-section in FIG. 3. Housing 30 has contacts 20 therein, and shell 60 is secured thereto to surround mating face 12. Diodes 100 are soldered on diode-containing flange surfaces 66 of transverse flange section 64 in positions corresponding to respective contacts 20. Shell 60 further is shown including mounting flange portions 68 containing apertures 70 for receipt therethrough of screw fasteners of a mating connector (not shown); tabs 74 extend forwardly from sides of mounting flange portions 68 for being clinched to housing 30 upon assembly. Lead frames 110 each include a pluralities of strap portions initially joined to carrier strips 112 which become discrete straps 114 corresponding to respective contacts 20 and diodes 100 associated therewith. Flange covers 80 and face cover 82 will eventually become part of the assembly, with flange covers 80 being secured forwardly of straps 114 and diodes 100 and face cover 82 being secured forwardly of mounting face 14 adjacent the array of first pin sections 22, as seen in FIG. 1.

Housing 30 may be for example molded of thermoplastic material such as liquid crystal polymer; conductive shell 60 may be drawn for example of cold rolled steel and tin-plated; contacts 20 may be stamped and formed for example of a phosphor bronze alloy.

Referring to FIGS. 2 through 5, housing 30 includes central portion 34 containing contact passageways 32 in which contacts 20 are secured; mounting flanges 36 at opposed ends of central portion 34 within apertures 38 of which are board mounts 40 for physically securing connector assembly 10 to a printed circuit board upon mounting; and lateral flange sections 42 along each side of housing 30 opposed from diode-containing flange surfaces 66 of shell 60 and sides of mounting flange portions 68 of shell 60. Board mounts 40 include threaded apertures into their rearward ends to threadedly receive screw fasteners of the mating connector extending through apertures 70 of shell 60. Aligned with contact locations along side surfaces 44 of housing 30 are undercut slots 46 extending rearwardly from mounting face 14 to lateral flange sections 42. Slots 46 are in communication with channels 48 which extend transversely outwardly along forward side 50 of lateral flange sections 42 to side surfaces 52 thereof, and channels 48 are aligned not only with slots 46 but also with diodes 100 mounted on shell 60. Lateral flange sections 42 further include recesses 54 extending inwardly from side surface 52 thereof and forming openings in the bottoms of channels 48 within which respective ones of diodes 100 will be disposed upon assembly.

Figures 5, 6:
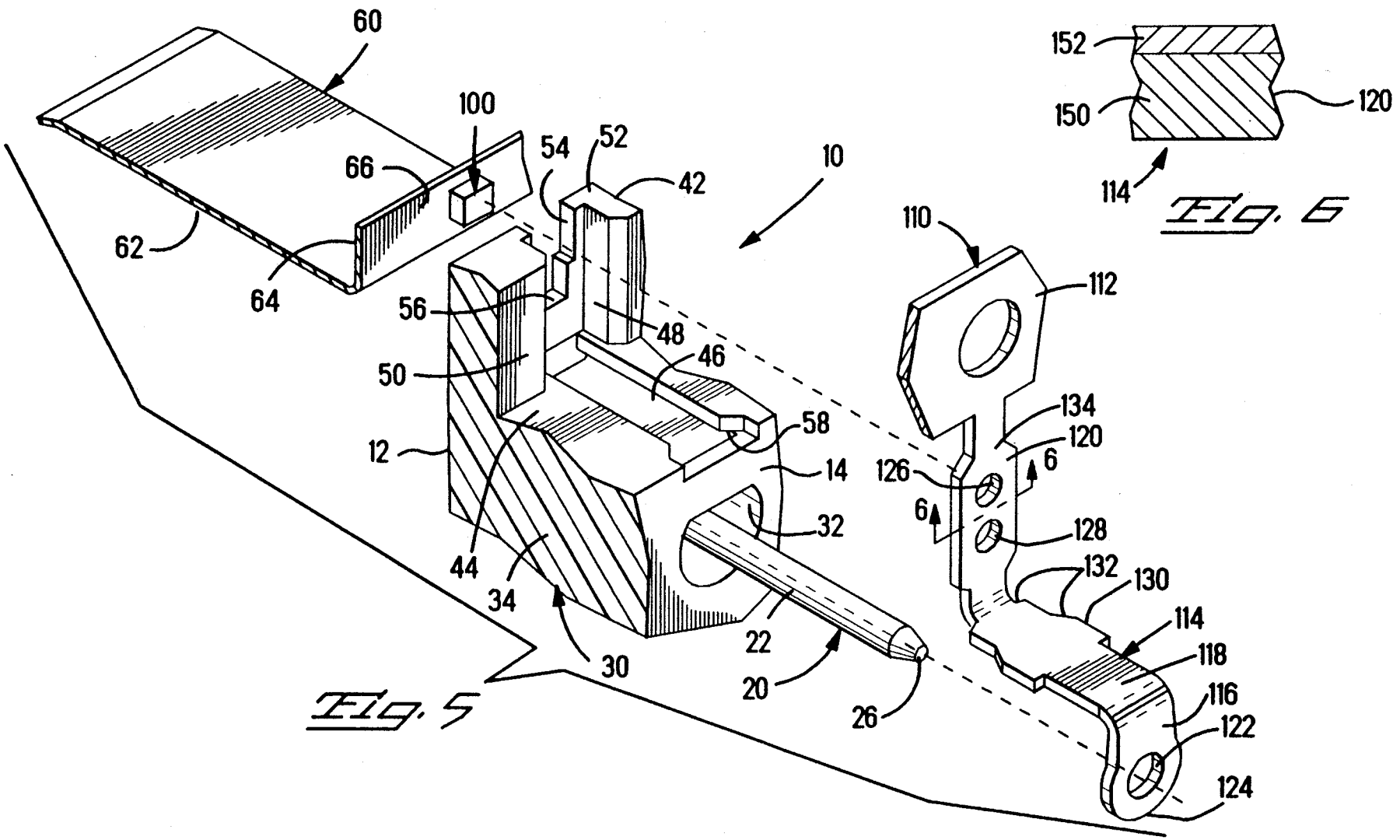
FIG. 5 is an enlarged exploded isometric view of a representative circuit location from a contact to the corresponding diode, including a discrete strap to interconnect them when inserted along a slot of the housing.
FIG. 6 is an enlarged part section view taken along lines 6—6 of a discrete strap of FIG. 5 illustrating the two layers of an embodiment of strap which comprises a Curie point heater for reflowing solder.

Referring particularly to FIG. 5, each discrete strap 114 includes a first strap section 116, an intermediate strap section 118 and a second strap section 120 which is shown joined to carrier strip 112. Intermediate strap section 118 is formed to have an axial orientation, and first and second strap sections 116,120 are formed to extend transversely from opposed ends of intermediate strap section 118 in opposed directions. First strap section 116 includes an aperture 122 near first end 124 thereof which is adapted to be placed over a first section 22 of an associated contact 20 during assembly, whereafter it is soldered thereto such as in a process using annular preforms of solder 98. Each first strap section 116 is of a length selected to position aperture 122 about a first section 22 when intermediate strap section 118 is retained within slot 46 aligned with the first section 22.

Second strap section 120 of each discrete strap 114 is of a length selected to extend from side surface 44 of housing 30 to be adjacent a respective diode 100. Each second strap section 120 preferably includes at least one aperture 126 aligned with a diode 100 to permit solder paste placed therein (or a solder preform formed therein) to flow to the diode's second electrode adjacent thereto when melted during solder reflow. Optionally a second aperture 128 extends through second strap section 120 and is adjacent a recess extension 56 of lateral flange section 42 to permit solvent flow during cleaning after soldering to remove flux. Each strap 114 may be of copper or copper alloy with plating to resist corrosion, and the solderable surfaces should be plated for solder promotion such as with nickel underplating and tin-lead coating thereover.

During assembly of lead frames 110 onto housing 30, the apertures 122 of first strap sections 116 are placed over leading ends 26 of first sections 22 of contacts 20. As each lead frame 110 is moved toward mounting face 12, the forward ends of intermediate strap sections 118 enter slots 46 from mounting face 12. Slots 46 may have undercuts 58 so that wide portions 130 of intermediate strap sections 118 will enter the undercuts and thereafter hold intermediate strap sections 110 against side surface 44 of housing 30. Preferably wide portions 130 are incrementally wider than the width of slots 46 at undercuts 58 to generate a force fit for retention of straps 114 to housing 30 after assembly; preferably leading edges 132 of intermediate strap sections 118 and wide portions 130 are tapered to facilitate entry into slots 46 and undercuts 58. When lead frames 110 are fully positioned on housing 30, second strap sections 120 will enter channels 48 which will locate second strap sections 120 to be aligned with and adjacent to diodes 100. Channels 48 also thereafter serve to prevent rotation or misalignment or stress from forces tending to rotate or misalign second strap sections after soldering to diodes 100. Solder paste may now be applied in apertures 126 and reflowed to solder second strap sections 120 to second electrodes of diodes 100. Diodes 100 being disposed in recesses 54 of lateral flange portions 42 of housing 30 are thus protected substantially by solid material therearound. Potting material 84 such as acrylated epoxy resin preferably is placed around all exposed portions of diodes 100, in recesses 54,56 and in channels 48 and cured. Thereafter flange covers 80 of dielectric material such as polybutylteraphthalate may then be adhered or otherwise mounted to lateral flange portions 42 to cover channels 48 and recesses 54 and second strap sections 120 of discrete straps 114 after soldering. Face cover 82 of dielectric material such as a heat resistant, glass-filled polyimide resin also preferably is adhered onto mounting face 14 of housing 30 to cover first strap sections 116 and solder terminations thereof to contacts 20. Carrier strips 112 secured to second ends 134 of straps 114 at frangible sections, may now be broken off.

Each discrete strap 114 is of the type having a layer of magnetic material disposed at least on a portion thereof, intimately joined to its surface and defining a self-regulating temperature heater to reflow solder when subjected to radio frequency current, in a manner as is generally disclosed in U.S. Pat. Nos. 4,256,945 and 4,659,912. As shown in FIG. 6, lead frames 110 are preferably formed from a low resistance metal such as copper or a copper alloy having minimal magnetic permeability, thus defining a first layer 150. A second layer 152 is then formed on the surface of first layer 150 such as by roll cladding or bonding, and comprises at least one skin depth of a metal having high magnetic permeability and high electrical resistance. For example, a layer 152 of nickel-iron alloy such as Alloy 42 (42 percent nickel, 58 percent iron) may be clad to portions of each discrete strap adjacent first and second strap sections, having a thickness of about 0.0007 to 0.0010 inches, remote from the surfaces to which solder is to adhere. A solder resist material such as inert polyimide resin could optionally be used along intermediate strap section 118.

As shown in FIG. 7, radiofrequency current is induced in straps 114 by apparatus 300 including a coil 302 surrounding the connector assembly. Sources of appropriate current are disclosed in U.S. Pat. Nos. 4,626,767 and 4,789,767 which generate radio frequency current of 13.56 megahertz. The selected Curie point temperature may be for example about 240° C., and the solder may be selected to have a reflow temperature of about 183° C.; the solder may be for example Sn 63 tin-lead. It would be convenient to clad such a magnetic layer onto the central portion of the copper or copper alloy strip from which the individual straps will then be stamped and thereafter formed, thereby defining a magnetic layer over the entire intermediate strap section 118, which would assuredly provide thermal energy to both first and second strap sections 116,120 for both solder joints.

Another embodiment of strap would provide the magnetic layer only at the second strap section 120 to solder only to the diode, where soldering of the first strap section 116 would be performed later when the pin contact sections 22 are being soldered such as to a circuit board in a through-hole or the like, still utilizing the solder preform 98 assembled in place as before. Similarly, the carrier strip 112 itself could include the magnetic layer where only the second strap section 120 is to be soldered during connector fabrication.

Alternatively a bimetallic foil heater preform 0.002 inches thick may be secured such as by roll cladding to the surface of the strap sections near the solderable surfaces, the heater preform having a low resistance layer such as copper to be placed adjacent and intimately secured to the discrete strap's surface, and a magnetic layer such as nickel-iron Alloy 42 0.0007 inches thick.

FIG. 8 is an embodiment of a plug type connector 200 having diodes 202 mounted on shell 204 and having discrete straps 206 joining the diodes to first sections 208 of contacts 210 extending from mounting face 212. Second sections 214 of contacts 210 are socket contact sections secured within respective passageway sections 216 of plug portion 218 of housing 220 but exposed along mating face 222 for mating with corresponding pin contact sections of a mating receptacle connector (not shown).

It is seen that the housing and the discrete straps are shaped and dimensioned to facilitate assembly of discrete straps directly to the connector housing and can include mounting the diodes (or other components of similar size) directly to an existing connector shell component which would not necessitate the fabrication of an additional intermediate component containing the diodes and the circuit elements. The outer portions of the housing are dormed in a manner which aligns the discrete straps during assembly and secures the straps afterward to protect the solder joints. The present invention maintains the cross-sectional dimensions and shape of the connector and not requiring modification of the contacts nor alteration of the position of the first strap sections extending from the mounting face, thus preserving the mounting interface for compatability with existing printed circuit board through-hole arrays.

It is foreseeable that first sections of the contacts may be adapted for surface mounting by having transverse foot portions for soldering to traces on the surface of a printed circuit board, with apertured first strap sections of the discrete straps adapted to be inserted over free ends of the foot portions from laterally of the connector and then moved upward along the array of contacts with the lead frame able to be reoriented as appropriate, after which intermediate strap sections can enter slots along the side surfaces of the housing as in FIG. 5. It is additionally foreseeable that more than two rows of contacts may be accommodated by forming the lead frame so that certain discrete straps have longer first strap sections to extend further into the contact array to reach contacts of an inner row; similarly it is foreseeable that the diodes may be arranged other than in a single row, with the second strap sections being formed to have an appropriate length.

Other variations and modifications may be made to the present invention which are within the spirit of the invention and the scope of the claims.

What is claimed is:

1. An electrical connector of the type for transmitting signals and having a dielectric housing means, a plurality of contacts secured in passageways thereof and extending from a mounting face to a mating face of the connector, and further having a conductive shell secured to the housing, said connector further comprising:

said dielectric housing means having a body extending between said mounting face and said mating face and having side surfaces;

said conductive shell mountable to and about at least a portion of said housing means;

a conductive means at least electrically connected to said conductive shell;

said plurality of electrical contacts secured in said housing means and including first sections extending from said mounting face for being connected to corresponding contact means of a corresponding first electrical article, and further including second sections at least exposed along said mating face for electrical connection with mating contacts of a corresponding second electrical article;

a like plurality of small electrical components initially attached to only said conductive means each at a location associated with a respective one of said electrical contacts and having first electrodes electrically connected to said conductive means for grounding, each component having a second electrode separate from said first electrode; and a like plurality of discrete straps extending from first strap sections each adjacent a respective said contact first section along said mounting face, each said strap including an intermediate strap section extending to a second strap section adjacent a said second electrode of an associated said component to be electrically connected thereto, each said strap to define a circuit from a said contact to an associated said component with said conductive means and said conductive shell defining a ground means of said component;

each said strap comprising a first metal having low magnetic permeability and low electrical resistance, and at least a portion thereof including a layer of a second metal having high magnetic permeability and high electrical resistance, to define a self-regulating temperature heater to generate thermal energy for melting solder when subjected to constant amplitude high frequency alternating current, whereby after being secured to said housing, each said strap is adapted to provide thermal energy for soldering at least said second strap section to a respective said second electrode of said component when subjected to said constant amplitude high frequency alternating current, thereafter completing said circuit from a said contact to an associated said component with said conductive means and said conductive shell, thereby facilitating fabrication of a circuit-protected connector.

2. The electrical connector as set forth in claim 1 wherein said layer of said second metal of each said discrete strap is disposed along a surface of said intermediate portion thereof and at least extending to said first and second strap sections.

3. The electrical connector as set forth in claim 1 wherein said layer of said second metal of each said discrete strap is disposed along said second strap section on a surface thereof facing away from said second electrode of said component.

4. The electrical connector as set forth in claim 1 wherein said layer of said second metal of each said discrete strap is disposed along a carrier strip of a lead frame of a plurality of said discrete straps initially joined to said second strap sections of said straps, and said carrier strip being later removed after said soldering.

5. A method for making an electrical connector having electrical components electrically connected to respective contacts thereof, comprising the steps of:

initially electrically connecting first electrodes of a like plurality of electrical components to only a conductive means of said connector at least electrically connected to a conductive shell of said connector;

identifying an apparatus being capable of generating a constant amplitude high frequency alternating current of known frequency;

forming a plurality of discrete straps associated with respective said contacts of said connector, each strap including a first strap section adapted to be electrically connected to a respective said contact, an intermediate strap section extending from said first strap section and to a second strap section extending to an end, each said strap comprising a metal having low magnetic permeability and low electrical resistance, and at least a portion thereof including a layer of second metal having high magnetic permeability and high electrical resistance, to define a self-regulating temperature heater to generate thermal energy for melting solder when subjected to said constant amplitude high frequency alternating current of said known frequency;

assembling said plurality of discrete straps to said connector with said intermediate strap sections extending along side surfaces of a dielectric housing of said connector, said first strap sections at least adjacent portions of said contacts, and said second strap sections at least adjacent second electrodes of said electrical components, said solder material selected to having a nominal melting temperature slightly less than the Curie temperature of said second metal of said straps; and thereafter generating said constant amplitude high frequency alternating current in said apparatus for a selected length of time, thereby reflowing said solder material and electrically connecting at least said second strap sections to said second electrodes.

6. The method as set forth in claim 5 wherein a preform of said solder material is held adjacent each said contact by said first strap section, and said layer of second metal is maintained remote from said first strap section, enabling later soldering of said contact to said first strap section during ultimate soldering of said contact to a corresponding contact means of a corresponding electrical article.

7. The method as set forth in claim 5 wherein said layer of second metal is provided on a carrier strip initially joined to second ends of said second strap sections, enabling transmittal of thermal energy generated by said known current, to at least said second strap sections, and said carrier strip is then removed from said second ends to electrically separate the circuits defined by associated ones of said components, said straps and said contacts.

* * * * *